US010844731B2

(12) United States Patent
Baek

(10) Patent No.: US 10,844,731 B2
(45) Date of Patent: Nov. 24, 2020

(54) CANTILEVERED VANE AND GAS TURBINE INCLUDING THE SAME

(71) Applicant: DOOSAN HEAVY INDUSTRIES & CONSTRUCTION CO., LTD., Changwon-si (KR)

(72) Inventor: Seol Baek, Yangju-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 119 days.

(21) Appl. No.: 15/976,845

(22) Filed: May 10, 2018

(65) Prior Publication Data

US 2018/0363472 A1 Dec. 20, 2018

(30) Foreign Application Priority Data

Jun. 20, 2017 (KR) ..... 10-2017-0077731

(51) Int. Cl.
*F01D 5/18* (2006.01)
*F01D 5/14* (2006.01)
(Continued)

(52) U.S. Cl.
CPC ..... *F01D 5/187* (2013.01); *F01D 5/141* (2013.01); *F01D 5/16* (2013.01); *F01D 5/3007* (2013.01);
(Continued)

(58) Field of Classification Search
CPC . F01D 5/141; F01D 5/147; F01D 5/18; F01D 5/186; F01D 5/187; F01D 5/3007; F01D 9/041; F01D 9/042; F01D 9/044
See application file for complete search history.

(56) References Cited

U.S. PATENT DOCUMENTS 2,714,499 A * 8/1955 Warner ..... F01D 5/20 416/243
2,795,373 A * 6/1957 Hewson ..... F04D 29/544 138/39
(Continued)

FOREIGN PATENT DOCUMENTS

EP 1524405 4/2005
EP 2921647 A1 9/2015
(Continued)

OTHER PUBLICATIONS

An European Search Report dated Nov. 27, 2018 in connection with European Patent Application No. 18174828.6 which corresponds to the above-referenced U.S. application.

*Primary Examiner* — Moshe Wilensky
*Assistant Examiner* — Christopher R Legendre
(74) *Attorney, Agent, or Firm* — Invenstone Patent, LLC

(57) ABSTRACT

A cantilevered vane, for use with a rotary disc of a gas turbine, includes a root supported in a dovetail slot formed in a circumferential surface of the rotary disc; and an airfoil protruding a predetermined height from the root and having a J-shaped cross-section throughout a front-wing portion and a rear-wing portion of the airfoil. The airfoil includes a straight portion vertically extending upward from the root by a predetermined height; and a curved portion integrally formed with an upper end of the straight portion to cantilever toward one side of the airfoil, the curved portion being inclined at a predetermined angle with respect to the straight portion. Cooling fluid flows through a first channel formed in the straight portion and a second channel formed in the curved portion. The first channel includes front-wing and rear-wing channels for guiding the cooling fluid to the front-wing and rear-wing portions.

14 Claims, 5 Drawing Sheets

(51) Int. Cl.
*F01D 5/16* (2006.01)
*F01D 5/30* (2006.01)

(52) U.S. Cl.
CPC ..... *F05D 2220/32* (2013.01); *F05D 2260/20* (2013.01)

(56) References Cited

U.S. PATENT DOCUMENTS

| | | | | |
|---|---|---|---|---|
| 5,368,441 | A * | 11/1994 | Sylvestro | F01D 5/187 416/90 A |
| 5,716,192 | A * | 2/1998 | Phillips | F01D 5/187 415/115 |
| 6,290,465 | B1 * | 9/2001 | Lammas | F01D 5/141 416/219 R |
| 6,312,219 | B1 | 11/2001 | Wood et al. | |
| 8,100,655 | B2 * | 1/2012 | Stone | B23C 3/18 29/889.2 |
| 9,828,864 | B2 * | 11/2017 | Whitehurst | F01D 5/3092 |
| 2009/0246032 | A1 | 10/2009 | Stone et al. | |
| 2015/0233259 | A1 | 8/2015 | Whitehurst et al. | |
| 2015/0322798 | A1 * | 11/2015 | Bauer | F01D 5/141 416/95 |
| 2018/0363472 | A1 * | 12/2018 | Baek | F01D 5/141 |
| 2019/0128124 | A1 * | 5/2019 | Baek | F01D 5/187 |

FOREIGN PATENT DOCUMENTS

| | | | |
|---|---|---|---|
| JP | 140402 | A | 5/1990 |
| JP | 2693527 | A | 9/1997 |
| JP | 508671 | A | 8/1998 |
| JP | 2005030387 | A | 2/2005 |
| KR | 20140014252 | A | 2/2014 |
| KR | 20140108406 | | 9/2014 |
| WO | 2007/003614 | A1 | 1/2007 |
| WO | 2014/031160 | A1 | 2/2014 |
| WO | 2015/134005 | A1 | 9/2015 |

* cited by examiner

[Fig.1]
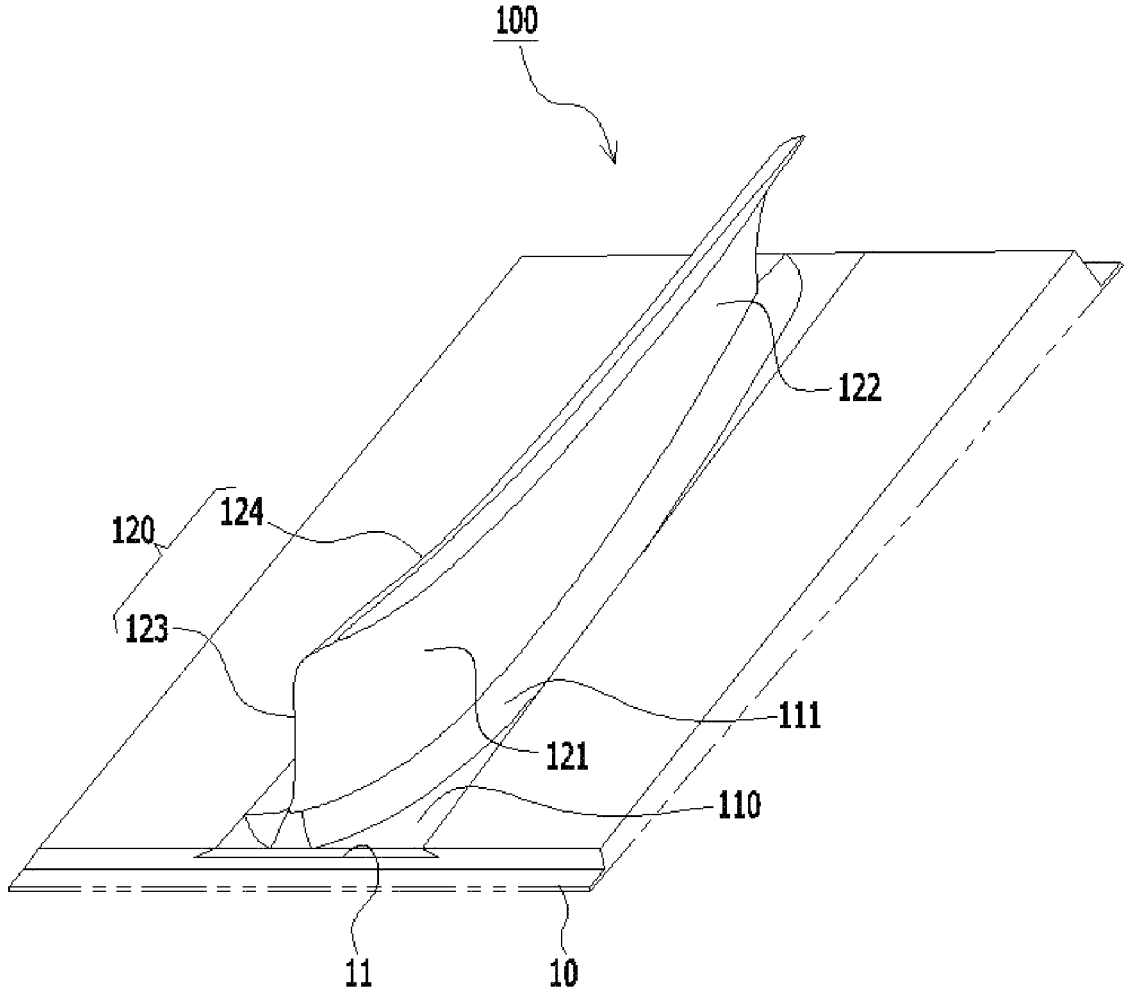

[Fig.2]
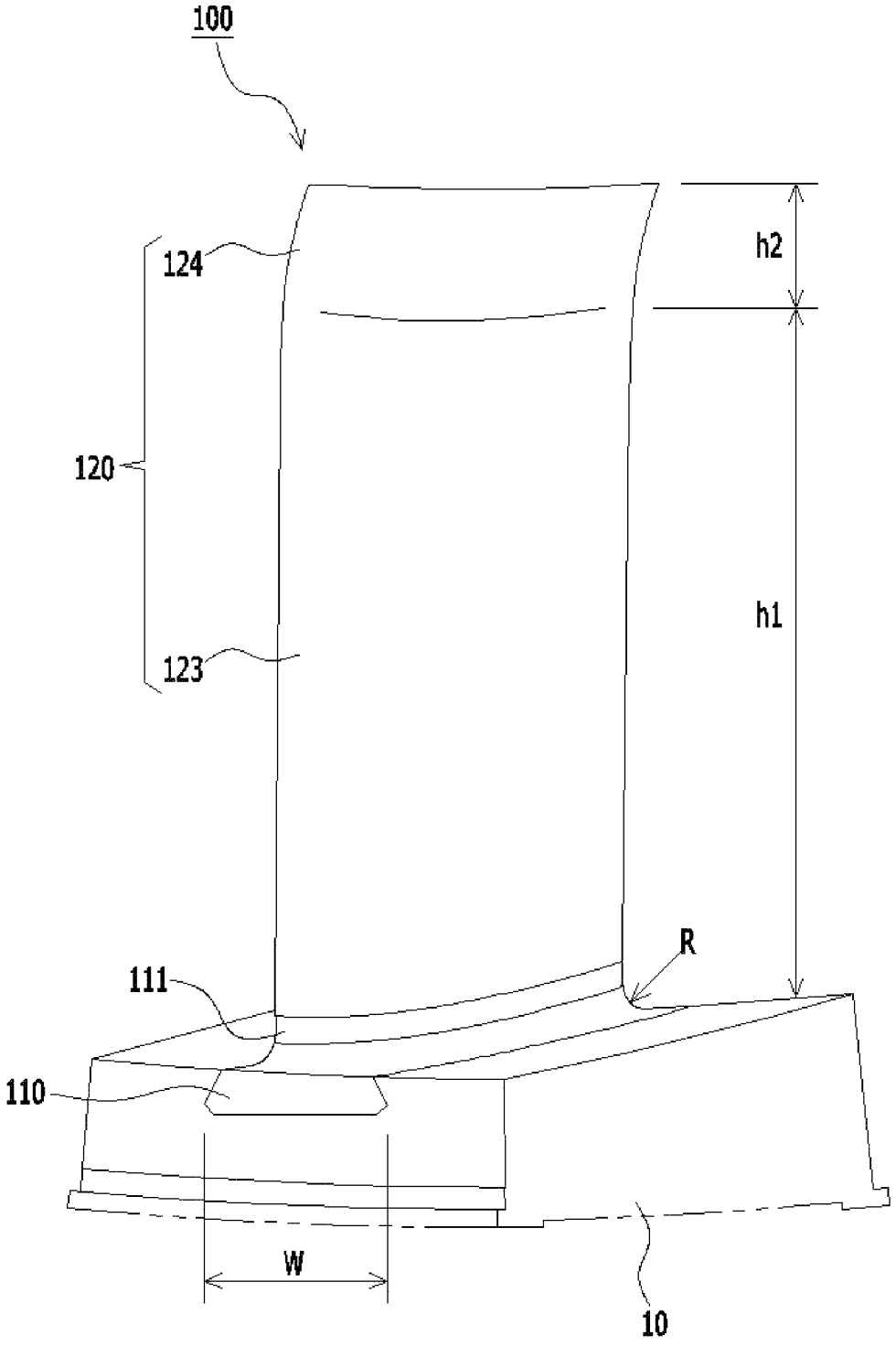

[Fig.3]
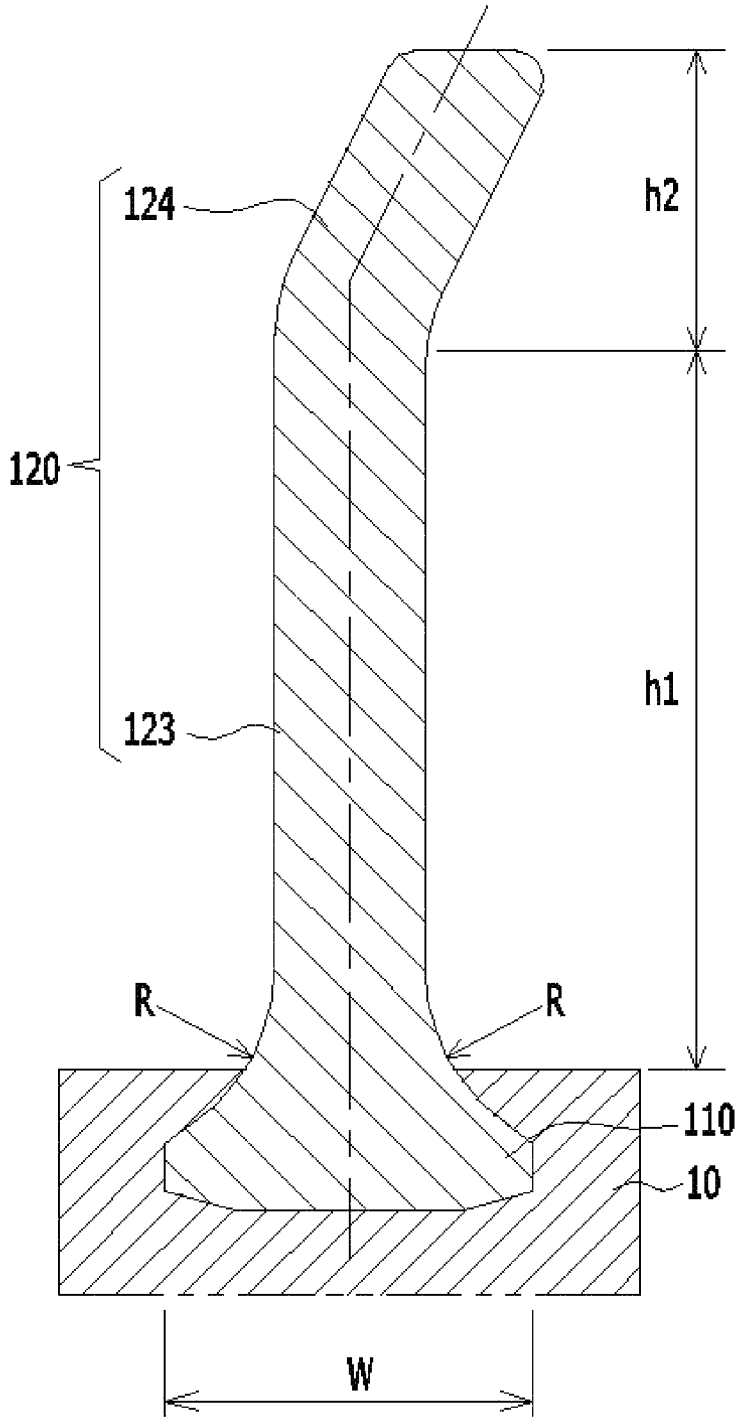

[Fig.4]
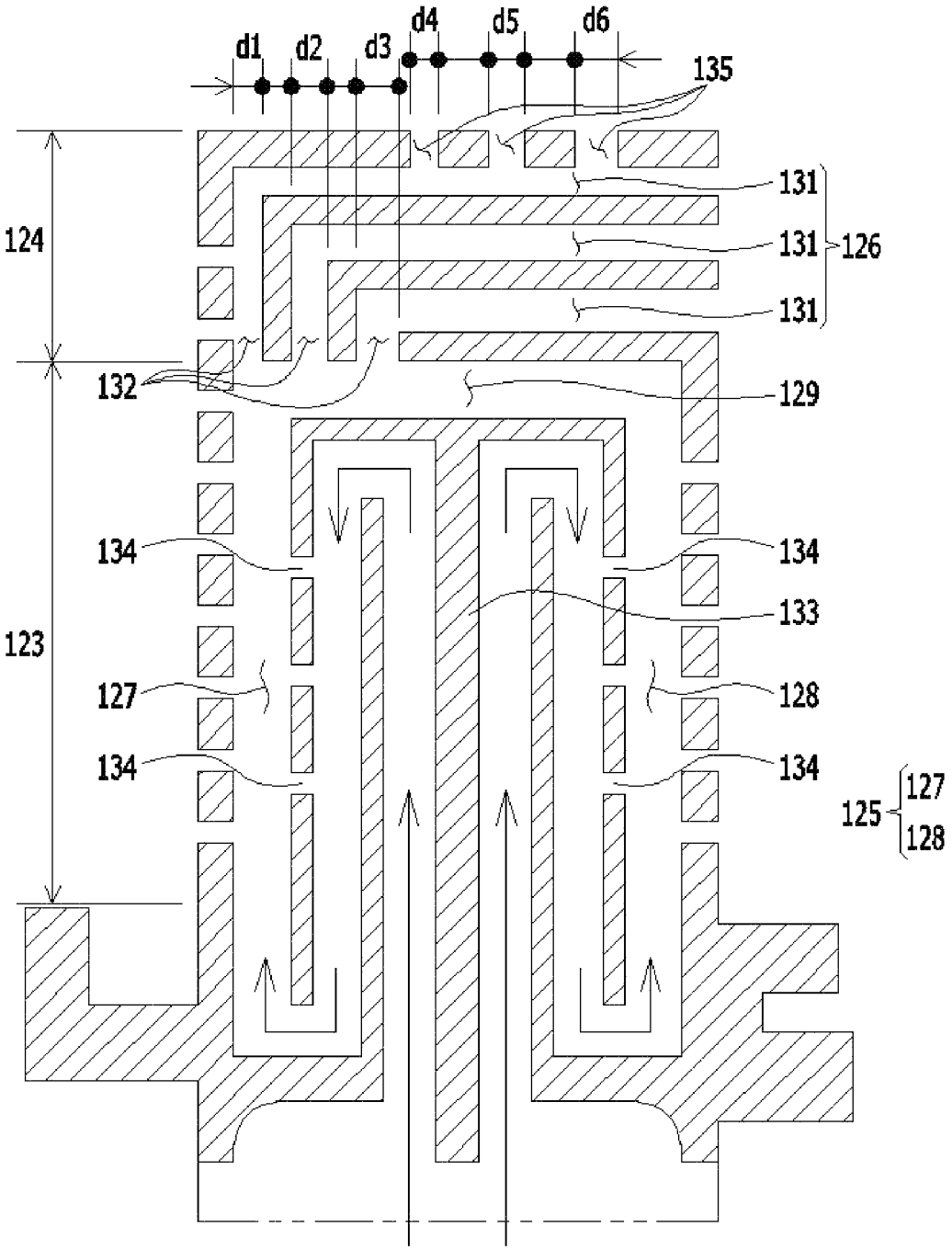

[Fig.5]
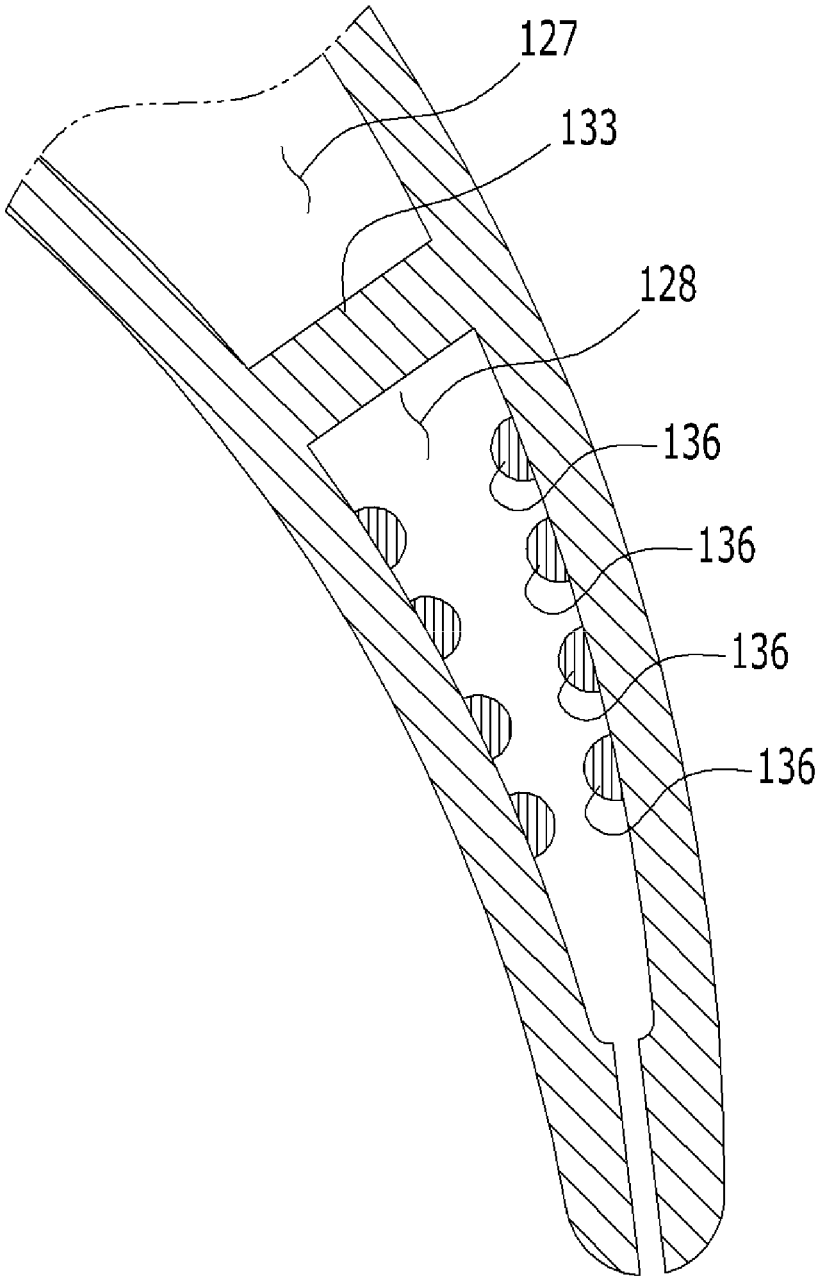

CANTILEVERED VANE AND GAS TURBINE INCLUDING THE SAME

CROSS REFERENCE TO RELATED APPLICATIONS

The present application claims priority to Korean Patent Application No. 10-2017-0077731, filed Jun. 20, 2017, the entire contents of which is incorporated herein for all purposes by this reference.

BACKGROUND OF THE INVENTION

Field of the Invention

The present invention relates to a cantilevered vane and a gas turbine including the same and, more particularly, to a cantilevered vane having a structure that can reduce airfoil rubbing and can contribute to vibration stability of a vane hub.

Description of the Related Art

In general, a turbine is a mechanical device that obtains torque from an impulse or reaction force, using the flow of a compressed fluid such as gas. A device using steam is called a steam turbine and a device using combustion gas is called a gas turbine.

A gas turbine is composed of a compressor, a combustor, and a turbine. The compressor suctions air from the atmosphere, compresses the air, and supplies the combustor with the compressed air for combustion. The combustor produces high-energy combustion gas by mixing fuel with the compressed air from the compressor and burning the mixture, and then discharging the high-temperature, high-pressure combustion gas toward a series of rotating blades in the turbine. The turbine converts the force applied to the blades by an expansion of the combustion gas into mechanical energy.

The mechanical energy obtained by the turbine is supplied as energy (about 60% of the entire power from the turbine) for the compressor for compressing air. The remaining energy is used for driving a power generator and thereby generating power.

The operating principle of a gas turbine, which encompasses the turbine's thermal cycle, known as the Brayton cycle, is to first suction air from the atmosphere, compress the air through a compressor, send the compressed air to a combustor, produce high-temperature and high-pressure gas through the combustor, operate a turbine using the gas, and then discharge exhaust gas to the atmosphere. The operation is composed of the four basic processes of compression, heating, expansion, and dissipation.

The turbine blades are key components of common gas turbines. A contemporary turbine blade is realized as a shroud-type vane having a bowed cross-section and C-shaped structure in which roughly equal acute angles are present at both the vane hub and the vane tip. The structure of such a shroud-type vane exhibits a low natural frequency, so there is a possibility of flutter (vibration) in a lower mode of a gas turbine, thereby inducing instability of the vane hub and an increased tendency toward vibration and the rubbing associated with vibration.

Accordingly, there is a need for a gas turbine blade technology, including gas turbine vanes, to solve the problem in the contemporary art.

SUMMARY OF THE INVENTION

Accordingly, it is an object of the present invention to provide a cantilevered vane having a structure that can contribute to the vibration stability of a vane hub.

It is another object of the present invention to provide a cantilevered vane having a stable structure that improves the efficiency of cooling an airfoil.

According to one aspect of the present invention, there is provided a cantilevered vane including a root configured to be supported in a dovetail slot formed in a circumferential surface of a rotary disc of a gas turbine; and an airfoil protruding a predetermined height from the root and having a J-shaped cross-section throughout a front-wing portion and a rear-wing portion of the airfoil.

The airfoil may include a straight portion vertically extending upward from the root by a predetermined height; and a curved portion integrally formed with an upper end of the straight portion to cantilever toward one side of the airfoil, the curved portion being inclined at a predetermined angle with respect to the straight portion.

The cantilevered vane may further include a first channel formed in the straight portion through which cooling fluid can flow, and a second channel formed in the curved portion through which the cooling fluid can flow.

The first channel may include a front-wing channel for guiding the cooling fluid to the front-wing portion of the airfoil; and a rear-wing channel for guiding the cooling fluid to the rear-wing portion of the airfoil.

The cantilevered vane may further include an exhaust connection channel communicating with the second channel to discharge cooling fluid from the airfoil. The exhaust connection channel may connect the front-wing channel to the rear-wing channel and may be configured to discharge cooling fluid from the airfoil, sequentially, through the front-wing channel, the second channel, the rear-wing channel, and then outside the airfoil.

The first channel may include an exhaust connection channel communicating with the second channel to discharge cooling fluid from the airfoil.

The second channel may include a plurality of cooling channels extending toward the rear-wing portion of the airfoil.

The first channel and the second channel may communicate with each other via at least two exhaust connection ports, so that a portion of the cooling fluid flowing through the first channel flows through the second channel. The exhaust connection ports may have inner diameters that gradually increase in size in a flow direction of the cooling fluid, so that a flow rate of cooling fluid can be adjusted to a predetermined level.

The airfoil may be provided with at least two exhaust holes communicating with the second channel, so that a portion of the cooling fluid flowing through the second channel can be discharged from the airfoil. The exhaust holes may be formed at one end of the airfoil and have inner diameters that gradually increase in size toward the rear-wing portion of the airfoil. The exhaust holes may have inner diameters that gradually increase in size in a flow direction of the cooling fluid, so that a flow rate of cooling fluid can be adjusted to a predetermined level.

The cantilevered vane may further include a channel separation wall forming the front-wing channel and the rear-wing channel and for guiding cooling fluid. The channel separation wall may be configured to introduce cooling fluid from a bottom side of the airfoil and to guide the introduced cooling fluid through a series of paths formed by the channel separation wall, so that cooling fluid flows in alternating directions. The front-wing channel and the rear-wing channel may have at least two bypass holes formed through the channel separation wall to bypass one or more of the paths extending toward the front-wing portion and the rear-wing portion.

The cantilevered vane may further include a plurality of protrusions formed in the rear-wing channel to generate turbulence in a flow of the cooling fluid.

The curved portion may have a height that is 20-30% of a height of the straight portion.

The cantilevered vane may further include a rounded joint having a predetermined radius of curvature formed at a junction of the airfoil and the root. The predetermined radius may be 10-35% of a width of the root.

According to another aspect of the present invention, there is provided a gas turbine including a rotary disc and the above cantilevered vane.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description when taken in conjunction with the accompanying drawings, in which:

FIG. 1 is a perspective view of a cantilevered vane having a J-shaped structure including a front-wing portion and a rear-wing portion according to an embodiment of the present invention;

FIG. 2 is an alternative perspective view of the cantilevered vane of the present invention, illustrating the relative heights and formation of straight and curved portions of the J-shaped structure of the embodiment;

FIG. 3 is a cross-sectional view of a front side of the cantilevered vane shown in FIG. 2;

FIG. 4 is a conceptual cross-sectional view showing the internal structure of a cantilevered vane according to an embodiment of the present invention; and FIG. 5 is an enlarged view of a portion of a horizontal cross-section of the cantilevered vane shown in FIG. 4.

DETAILED DESCRIPTION OF THE INVENTION

Hereafter, embodiments of the present invention will be described in detail with reference to the accompanying drawings. The terms and words used in the present specification and claims should not be interpreted as being limited to typical meanings or dictionary definitions, but should be interpreted as having meanings and concepts relevant to the technical scope of the present invention.

Throughout the specification, if it is described that a component is formed on another component, a component may be directly provided on another component, or a component may be interposed between components. Through the present specification, unless explicitly described otherwise, "comprising" any components will be understood to imply the inclusion of other components rather than the exclusion of any other components.

FIG. 1 shows a cantilevered vane having a J-shaped structure including a front-wing portion and a rear-wing portion according to an embodiment of the present invention. FIG. 2 is an alternative view of the cantilevered vane of the present invention, for illustrating the relative heights and formation of straight and curved portions of the J-shaped structure.

Referring to FIGS. 1 and 2, a plurality of cantilevered vanes 100 according to an embodiment is disposed on dovetail slots 11 circumferentially arranged on the outer side of a rotary disc 10 of a gas turbine, is circumferentially arranged with a predetermined gap therebetween, and has a root 110 at the bottom of the vane and an airfoil 120 protruding a predetermined height from the root 110.

The cross-sectional structure of the airfoils 120 of the cantilevered vane 100 according to an embodiment may have a J-shape having a front-wing portion 121 and a rear-wing portion 122. The cross-sectional structure may have the same shape from the root 110 to a predetermined height.

Therefore, according to the present invention, a J-shaped airfoil structure having the front-wing portion 121 and the rear-wing portion 122 in the cross-section without a shroud structure is provided, so it is possible to provide a cantilevered vane having a structure that can contribute to vibration stability of a vane hub.

Referring to FIGS. 2 and 3, a rounded structure 111 having a predetermined radius of curvature may be formed at the joint of the airfoil 120 and the root 110 of the cantilevered vane 110 according to an embodiment. The radius R of curvature of the rounded structure 111 is not specifically limited as long as the airfoil 120 can be stably supported on the root 110. The radius or curvature R of the rounded structure 111 may be 10 to 35% of the width W of the root 110. Obviously, the radius R of curvature of the rounded structure 111 can be appropriately changed, depending on the operation environment and the intention of a designer.

The airfoil 120 according to an embodiment may have a straight portion 123 and a curved portion 124. The straight portion 123 may vertically extend a predetermined height upward from the root 110. The curved portion 124 may be integrally bent and inclined at a predetermined angle toward a side from the upper end of the straight portion 123, whereby the curved portion 124 forms the predetermined angle with respect to the straight portion 123. The curved portion 124 thus cantilevers toward one side of the airfoil 120.

The height h2 of the curved portion 124 can be appropriately changed, depending on the operation environment and the intention of a designer, but may be 20 to 30% of the height h1 of the straight portion.

FIG. 4 is a conceptual cross-sectional view showing the internal structure of a cantilevered vane according to an embodiment of the present invention. FIG. 5 is an enlarged view of a portion of a horizontal cross-section of the cantilevered vane shown in FIG. 4.

Referring to FIGS. 1-5, a first channel 125 through which cooling fluid can flow may be formed in the straight portion 123 according to an embodiment. The first channel 125, as shown in FIG. 4, may include a front-wing channel 127 and a rear-wing channel 128. A second channel 126 through which cooling fluid can flow may be formed in the curved portion 124.

In detail, the first channel 125 may include the front-wing channel 127 that guides cooling fluid to the front-wing portion 121 of the airfoil 120 and the rear-wing channel 128 that guides cooling fluid to the rear-wing portion 122 of the airfoil 120.

The first channel 125 may include an exhaust connection channel 129 to discharge cooling fluid, which flows in the front-wing channel 127, through second channel 126 and the rear-wing channel 128. The exhaust connection channel 129 may connect the front-wing channel 127, the rear-wing channel 128, and the second channel 126, whereby the exhaust connection channel 129 is configured to discharge cooling fluid from the airfoil 120, sequentially, through the front-wing channel 127, the second channel 126, the rear-wing channel 128, and then outside the airfoil 120.

The second channel 126 may include a plurality of cooling channels 131 extending toward the rear-wing portion of the airfoil 120.

Two or more exhaust connection ports 132 may be formed between the first channel 125 and the second channel 126 so that some of the cooling fluid flowing through the first channel 125 flows through the second channel 126. Thus, the first channel 125 and the second channel 126 communicate with each other via at least two exhaust connection ports 132, so that a portion of the cooling fluid flowing through the first channel 125 flows through the second channel 126. The inner diameters d1, d2, d3 of the exhaust connection ports 132 gradually increase in size in the flow direction of cooling fluid, so the flow rate of cooling fluid can be adjusted at predetermined level.

As shown in FIG. 4, the cantilevered vane 100 according to an embodiment may further include a channel separation wall 133 that guides cooling fluid. In effect, the front-wing and rear-wing channels 127 and 128 are formed by the channel separation wall 133 in order to guide the cooling fluid through a series of paths. The channel separation wall 133, the front-wing channel 127, and the rear-wing channel 128 according to an embodiment can guide cooling fluid flowing inside from the bottom through paths going up, down, and then up again. That is, the channel separation wall 133 is configured to introduce cooling fluid from a bottom side of the airfoil 120 and to guide the introduced cooling fluid through the series of paths formed by the channel separation wall 133, so that cooling fluid flows in alternating directions, i.e., up and down along the vertical length of the airfoil 120.

Two or more bypass holes 134 may be formed through the channel separation wall 133 toward the front-wing portion 121 and the rear-wing portion 122. Thus, the front-wing channel 127 and the rear-wing channel 128 have at least two bypass holes 134 formed through the channel separation wall 133 to bypass one or more of the paths extending toward the front-wing portion 121 and the rear-wing portion 122.

Two or more exhaust holes 135 connected to the second channel 126 may be formed at an end of the airfoil 120 so that some of cooling fluid flowing through the second channel 126 can be discharged to the end of the airfoil 120. The inner diameters d4, d5, d6 of the exhaust holes 135 are gradually increased toward the rear-wing portion of the airfoil 120, that is, in a flow direction of the cooling fluid, so the flow rate of cooling fluid can be adjusted at a predetermined level.

As shown in FIG. 5, a plurality of protrusions 136 protruding a predetermined height may be formed in the rear-wing channel 128 to be able to generate turbulent flow in the flow of cooling fluid.

As described above, the cantilevered vane of the present invention has an airfoil structure having a J-shaped cross-section throughout a front-wing portion and a rear-wing portion and thus contributes to the vibration stability of a vane hub without utilizing a shroud structure.

Further, the cantilevered vane of the present invention has a stable structure through a specifically rounded structure provided at the joint of a root and an airfoil.

Further, the cantilevered vane of the present invention has a J-shaped structure made up of the straight portion 123 and the curved portion 124 in which the first and second channels 125 and 126 are respectively formed in a specific structure by which the efficiency of cooling an airfoil is remarkably improved. The specific structure includes the front and rear-wing channels 127 and 128 of the first channel 125 and the plurality of protrusions 136 protruding a predetermined height in the rear-wing channel 128 to generate turbulence in the flow of cooling fluid.

Further, the exhaust connection ports 132 and exhaust holes 135 that have different inner diameters in accordance with positions induce similar exhaust amounts of cooling fluid.

Further, a gas turbine including the cantilevered vane 100 according to the present invention can be provided.

Therefore, according to the present invention, it is possible to provide a gas turbine including a structure that can contribute to vibration stability of a vane hub by including a cantilevered vane having a specific structure.

Only specific embodiments were described in the above detailed description. However, the present invention should not be construed as being limited to the specific embodiments described above, but should be construed as including all changes, equivalents, and substitutions within the spirit of the present invention defined in the claims.

The present invention is not limited to the specific embodiments and the above description and may be modified in various ways without departing from the scope of the present invention described in claims by those skilled in the art, and the modifications are included in the scope of the present invention.

What is claimed is:

1. A cantilevered vane comprising:

a root configured to be supported in a dovetail slot formed in a circumferential surface of a rotary disc of a gas turbine; and an airfoil including a front-wing portion and a rear-wing portion and protruding a height from the root, wherein the airfoil comprises:

a straight portion vertically extending upward from the root by a height and including a first channel through which cooling fluid can flow; and a cantilever portion integrally formed with an upper end of the straight portion to cantilever toward one side of the airfoil and including a second channel through which the cooling fluid can flow in an axial direction of the airfoil to be discharged from the airfoil via the rear-wing portion, the cantilever portion being inclined at an angle with respect to the straight portion, wherein the first channel comprises:

a front-wing channel for guiding the cooling fluid to the front-wing portion of the airfoil;

a rear-wing channel for guiding the cooling fluid to the rear-wing portion of the airfoil; and an exhaust connection channel communicating with the second channel to discharge the cooling fluid from the first channel to the second channel, the exhaust connection channel extending in the axial direction between the front-wing channel and the rear-wing channel, and wherein the exhaust connection channel of the first channel communicates with the second channel via at least two exhaust connection ports spaced apart from each other in the axial direction, so that a portion of the cooling fluid flowing through the first channel flows into the second channel via the exhaust connection channel and the at least two exhaust connection ports.

2. The cantilevered vane of claim 1, wherein the exhaust connection channel connects the front-wing channel to the rear-wing channel, and wherein the exhaust connection channel is configured to discharge the cooling fluid from the front-wing and rear-wing channels through the second channel.

3. The cantilevered vane of claim 1, wherein the second channel includes a plurality of cooling channels extending in the axial direction toward the rear-wing portion of the airfoil.

4. The cantilevered vane of claim 1, wherein the at least two exhaust connection ports include:

a first exhaust connection port disposed closest to an upstream end of the airfoil among the at least two exhaust connection ports; and a second exhaust connection port disposed farthest from the upstream end of the airfoil among the at least two exhaust connection ports, wherein each of the at least two exhaust connection ports has a different inner diameter, and wherein the at least two exhaust connection ports are arranged such that the respective inner diameters of the at least two exhaust connection ports gradually increase in size from the first exhaust connection port to the second exhaust connection port.

5. The cantilevered vane of claim 1, wherein the airfoil is provided with at least two exhaust holes that are spaced apart from each other in the axial direction and communicate with the second channel, so that a portion of the cooling fluid flowing through the second channel can be discharged from the airfoil in a radial direction of the airfoil.

6. The cantilevered vane of claim 5, wherein the at least two exhaust holes are formed adjacent to a downstream end of the airfoil and include:

a first exhaust hole disposed closest to the downstream end of the airfoil among the at least two exhaust holes; and a second exhaust connection port disposed farthest from the downstream end of the airfoil among the at least two exhaust holes, wherein each of the at least two exhaust holes has a different inner diameter, and wherein the at least two exhaust holes are arranged such that the respective inner diameters of the at least two exhaust holes gradually increase in size from the first exhaust hole to the second exhaust hole.

7. The cantilevered vane of claim 1, further comprising:

a channel separation wall forming the front-wing channel and the rear-wing channel and for guiding the cooling fluid.

8. The cantilevered vane of claim 7, wherein the cooling fluid is introduced to the airfoil at a bottom side of the airfoil, and wherein the channel separation wall guides the introduced cooling fluid at the bottom side and through a series of paths formed by the channel separation wall that extend in alternating directions.

9. The cantilevered vane of claim 8, wherein at least two bypass holes are formed through the channel separation wall to bypass one or more of the series of paths, the series of paths extending toward the front-wing portion and the rear-wing portion.

10. The cantilevered vane of claim 1, further comprising:

a plurality of protrusions formed in the rear-wing channel to generate turbulence in a flow of the cooling fluid.

11. The cantilevered vane of claim 1, wherein the cantilever portion has a height that is 20-30% of a height of the straight portion.

12. The cantilevered vane of claim 1, further comprising:

a rounded joint having a radius of curvature formed at a junction of the airfoil and the root.

13. The cantilevered vane of claim 12, wherein the radius of curvature is 10-35% of a width of the root.

14. A gas turbine comprising:

a rotary disc; and a cantilevered vane comprising:

a root configured to be supported in a dovetail slot formed in a circumferential surface of the rotary disc; and an airfoil including a front-wing portion and a rear-wing portion and protruding a height from the root, wherein the airfoil comprises:

a straight portion vertically extending upward from the root by a height and including a first channel through which cooling fluid can flow; and a cantilever portion integrally formed with an upper end of the straight portion to cantilever toward one side of the airfoil and including a second channel through which the cooling fluid can flow in an axial direction of the airfoil to be discharged from the airfoil via the rear-wing portion, the cantilever portion being inclined at an angle with respect to the straight portion, wherein the first channel comprises:

a front-wing channel for guiding the cooling fluid to the front-wing portion of the airfoil;

a rear-wing channel for guiding the cooling fluid to the rear-wing portion of the airfoil; and an exhaust connection channel communicating with the second channel to discharge the cooling fluid from the first channel to the second channel, the exhaust connection channel extending in the axial direction between the front-wing channel and the rear-wing channel, and wherein the exhaust connection channel of the first channel communicates with the second channel via at least two exhaust connection ports spaced apart from each other in the axial direction, so that a portion of the cooling fluid flowing through the first channel flows into the second channel via the exhaust connection channel and the at least two exhaust connection ports.

* * * * *